United States Patent [19]

Calfus

[11] Patent Number: 4,933,805

[45] Date of Patent: Jun. 12, 1990

[54] CIRCUIT FOR CONTROLLING INDUCTIVE LOADS, PARTICULARLY FOR THE OPERATION OF THE ELECTRO-INJECTORS OF A DIESEL-ENGINE

[75] Inventor: Marco Calfus, Turin, Italy

[73] Assignee: Marelli Autronica S.p.A., Milan, Italy

[21] Appl. No.: 234,875

[22] Filed: Aug. 22, 1988

[30] Foreign Application Priority Data

Aug. 25, 1987 [IT] Italy ..... 67729 A/87

[51] Int. Cl.[5] ..... H01H 47/00

[52] U.S. Cl. ..... 361/152; 123/490; 361/189

[58] Field of Search ..... 361/152, 153, 160, 166, 361/168.1, 191, 187, 170, 189, 190; 123/490

[56] References Cited

U.S. PATENT DOCUMENTS 4,454,558 6/1984 Hoddart ..... 361/153
4,600,966 7/1986 Mueller et al. ..... 361/166
4,618,908 10/1986 Anttila ..... 123/490

*Primary Examiner*—A. D. Pellinen
*Assistant Examiner*—Jeffrey A. Gaffin
*Attorney, Agent, or Firm*—Sughrue, Mion, Zinn, Macpeak & Seas

[57] ABSTRACT

A circuit for controlling an inductive load for an electro-injector of a diesel-cycle internal combustion engine is operated from the vehicle battery and includes a reactive circuit having an energy-storage inductor. A first switch controls the supply of current to the energy-storage inductor and a second switch is provided for connecting the reactive circuit to the inductive load for rapid discharge of the energy stored in the energy-storage inductor load into the inductive so as to inject a current pulse into the load. A by-pass branch circuit is connected between the first switch and the load and includes additional switch for enabling the passage of current from the battery to the load when the first and second switches are simultaneously closed.

6 Claims, 4 Drawing Sheets

CIRCUIT FOR CONTROLLING INDUCTIVE LOADS, PARTICULARLY FOR THE OPERATION OF THE ELECTRO-INJECTORS OF A DIESEL-ENGINE

BACKGROUND OF THE INVENTION

The present invention relates to a circuit for piloting an inductive load, particularly for the operation of an electro-injector for Diesel-cycle internal combustion engines.

More specifically, the invention relates to a circuit comprising a low-voltage supply, reactive circuit means including an energy-storage inductor, control circuit means including a first controlled switch for connecting the supply to the inductor to effect a storage of energy, and a second controlled switch for causing the connection of the reactive circuit means to the load and rapid discharge into the load of the energy stored in the inductor, so as to inject a current pulse into the load.

A circuit of this type is described in Italian patent application No. 67953-A/85. This known circuit comprises a plurality of circuit branches, each of which has a capacitor connected in parallel with an inductive load to form a resonant circuit with the load. The rapid transfer of current into each of these loads is achieved by first storing energy provided by the supply in the storage inductor and then connecting the storage inductor to the resonant circuit including the load to be energized. The control solenoids of the electro-injectors for Diesel engines represent non-linear inductive loads with a relatively small inductance.

For optimal and precise control of injection in a Diesel engine, the activation times for individual injectors must be precisely controllable. For this purpose, it is particularly necessary that the rise time of the current in the control solenoid of the electro-injector which is to be activated from time to time is extremely small, and less than the minimum injection time by at least one order of magnitude. It is also necessary that, at least in the initial stage of excitation, the current not only reaches a high value, but also that the integral of the current (linked to the force developed on the movable armature of the electro-injector control solenoid) is consistent. In other words, once the peak value has been reached the current in the load must remain at high levels, of the order of the peak value, for some time.

Known circuits of the above-specified type enable quite small rise times of the current in the load to be obtained; however, given the structure of such circuits, it is inevitable that energy will be transferred from the load back to the reactive energy storage and discharge circuit means thereof. In particular, in such circuits, once the current in the load has reached the peak value, it decays, tending towards the value defined purely by the resistive components of the circuit, with a time constant to whose definition the storage inductor also contributes.

In practice, when the peak value is reached, the current in the load decays with a smaller time constant and therefore more rapidly, the faster the current rises to its peak value.

SUMMARY OF THE INVENTION

The object of the present invention is to produce a circuit of the above type which, once the peak value of the current in the load has been reached, enables this current to be maintained at high levels of the same order as the peak value.

This object is achieved according to the invention by means of a circuit of the type specified above, the principal characteristic of which lies in the fact that it further includes a by-pass branch circuit connected between the first switch and the load, and including current conduction control means for enabling the passage of a current from the supply to the load when the first and second switches are simultaneously closed.

The conduction control means in the by-pass branch circuit may comprise an additional electronic switch or, more simply, a diode.

BRIEF DESCRIPTION OF THE DRAWINGS

Further character and advantages of the invention will become clear from the detailed description which follows with reference to the appended drawings, provided purely by way of non-limiting example, in which:

With reference to FIG. 1, a circuit according to the invention for controlling a plurality of inductive loads $L_i$ comprises an input terminal 1 connected in use to a direct-current low-voltage supply $V_B$, such as a battery. The inductive loads $L_i$ may represent, in particular, the control solenoids of the electro-injectors of a Diesel-cycle internal combustion engine of a motor vehicle. In this case, the supply $V_B$ is constituted by the battery of the vehicle.

A storage inductor is indicated $L_1$ and can be connected to the input terminal 1 by a controlled electronic switch, generally indicated $SW_1$, which is open at rest. The switch $SW_1$ has been illustrated as a cut-out, in parallel with which is connected a recirculating diode. This switch may be constituted, for example, by an integrated MOSFET-type transistor and, in this case, the diode $D_1$ is constituted by the intrinsic parasitic diode.

A diode is indicated $R_1$ and has its anode connected to earth and its cathode connected between the storage inductor $L_1$ and the controlled switch $SW_1$.

A further controlled switch $SW_2$, similar to $SW_1$, is connected between $L_1$ and earth in the manner illustrated.

A diode $R_2$ has its anode connected to $L_1$ and its cathode connected to a first terminal of a capacitor C the other terminal of which is connected to earth. Connected in parallel with C is a plurality of branch circuits, each including an inductive load $L_i$ in series with which is connected a controlled electronic switch $SW_i$ of similar type to $SW_1$ and $SW_2$. A respective capacitor $C_i$ may also be connected in parallel with each load $L_i$ for enabling the current in the corresponding load $L_i$ to be turned off, that is, rapidly cancelled out, when the load is de-energised.

An electronic control unit produced in known manner is indicated ECU and includes, for example, a microprocessor unit and input/output interface circuits. The unit ECU has a series of outputs connected in order to the control inputs of the switches $SW_1$, $SW_2$, and $SW_i$.

A by-pass branch circuit is indicated M and is connected between the switch $SW_1$ and the branch circuits containing the loads $L_i$. A current conduction control device, indicated B, is connected in the by-pass branch circuit. In the embodiment shown in FIG. 1, this device is constituted by a further electronic switch controlled by the unit ECU. In the embodiment shown in FIG. 4, the conduction control device in the by-pass branch circuit is constituted by a simple diode.

In order to pilot the electro-injectors of a Diesel engine, further electrical input signals, such as, for example, the rate of revolution of the engine, etc., are supplied to the control unit ECU.

Before describing the operation of the circuit shown in

Figure 1:
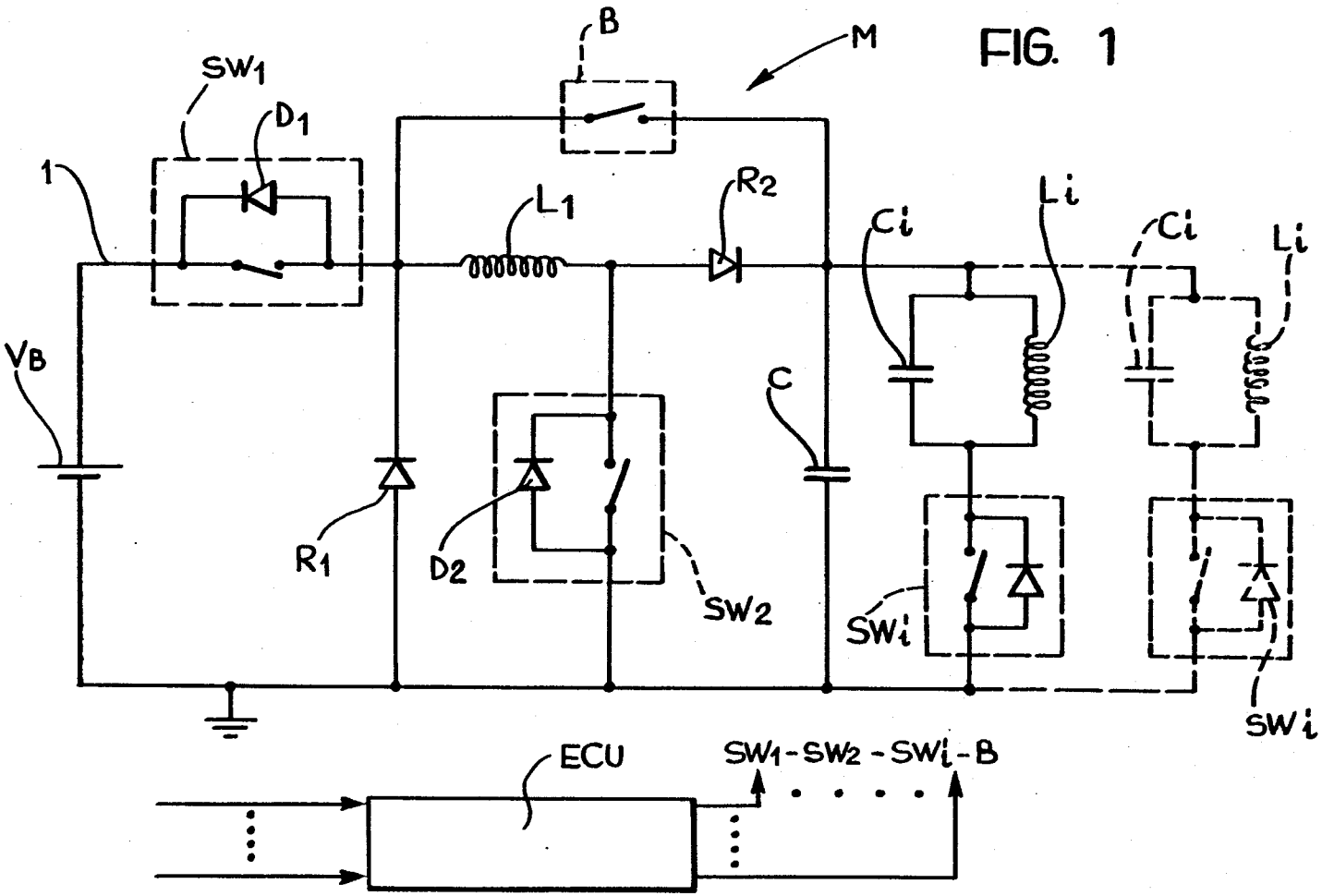
FIG. 1 is an electrical diagram of the circuit according to the invention.
Figure 2:
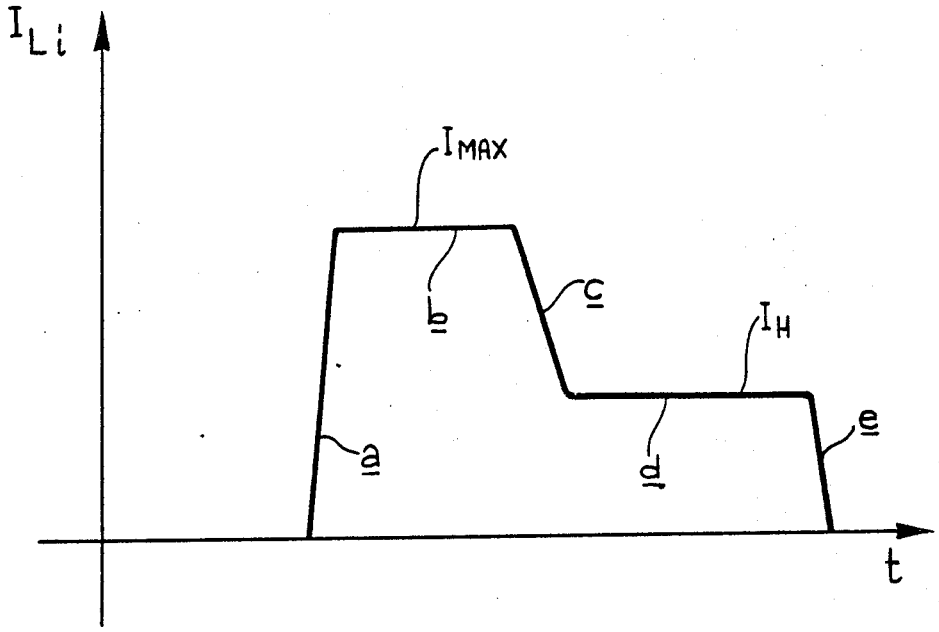
FIG. 2 is a graph which shows the ideal curve of the excitation current of the control solenoid of an electro-injector for a Diesel engine as a function of time.
Figure 4:
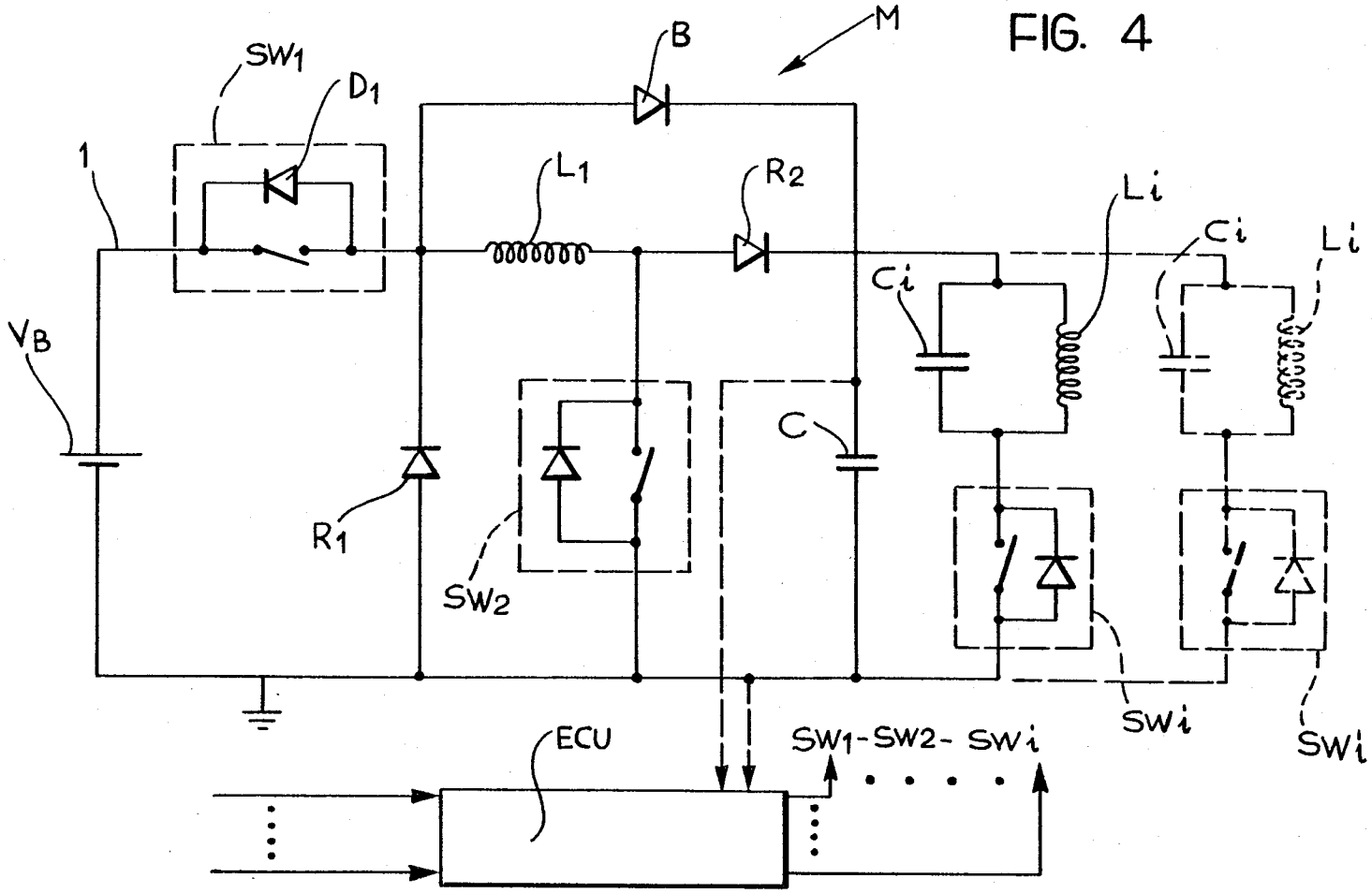
FIG. 4 shows a variant of the circuit shown in FIG. 1.

FIG. 1 and the variant shown in FIG. 4, some considerations concerning the ideal behaviour of the current $I_{Li}$ in the control solenoid of an electro-injector for a Diesel-cycle internal combustion engine will now be put forward. This ideal behaviour is shown in FIG. 2 as a function of time t. The ideal curve shown has a rising slope a followed by a stage b of substantially constant high current intensity $I_{max}$, which is followed by a transition c towards a level $I_H$ at which the current is maintained substantially constant. This current is maintained for a certain period of time (section d of the curve) and then followed by the "turning off" of the current (stage e).

Figure 3:
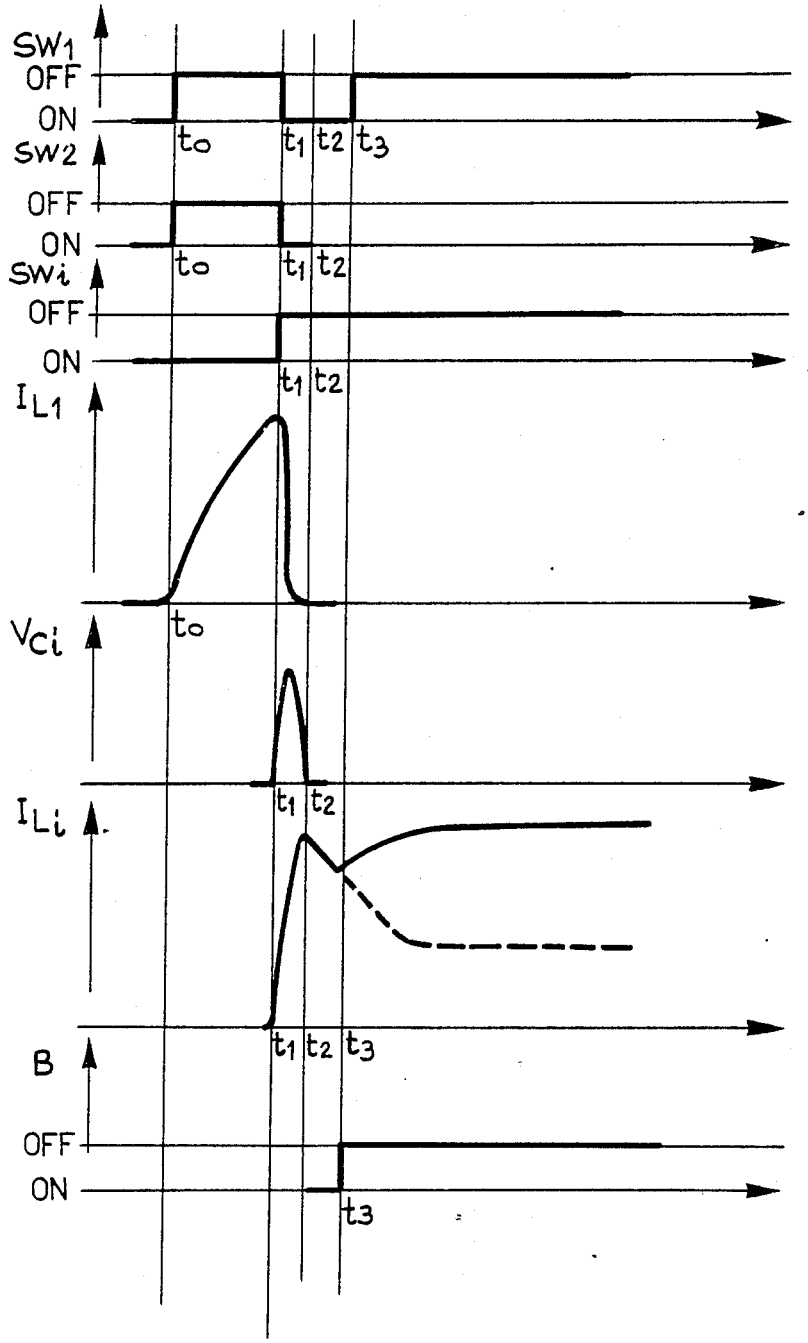
FIG. 3 is a series of graphs showing the state of devices of the circuit according to the invention and signals developed during operation of the circuit.

With reference to FIGS. 1, 3 and 4, we shall now see how, each time a load $L_i$ is to be activated, the circuit according to the invention is able to cause the current in that load to rise rapidly and to maintain the current at a very high level after it has reached its peak value.

FIG. 3 shows the states of $SW_1$, $SW_2$, the switch B, and the switch $SW_i$ associated with the load $L_i$ to be energised, and the trace of the current $I_{Li}$ in the storage inductor, the voltage $VC_i$ across the capacitor $C_i$ associated with the load $L_i$, and the trace of the current $I_{Li}$ in the load.

In order to make a current pass in the load $L_i$, the control unit ECU causes closure of $SW_1$ and $SW_2$ at an instant $t_0$. All the other switches, including B, remain open. In this condition, a current flows in the storage inductor $L_1$ with a rising trend, as shown in FIG. 3.

At a subsequent instant, indicated $t_1$, $SW_1$ and $SW_2$ are closed, while the switch $SW_i$ associated with the load to be energised is closed. In this condition, the storage inductor $L_1$ is disconnected from the supply but connected to the capacitor C with which it forms a resonant circuit.

This resonant circuit is discharged to the load $L_i$ associated with the switch $SW_i$ which has been closed. The current $I_{L1}$ decays in the manner illustrated, while the voltage across the capacitor $C_{Ci}$ increases and then decreases to zero at an instant $t_2$. Therefore, starting from the instant $t_1$, the current in the selected load $L_i$ has a rising trend with a steep leading edge until it reaches a peak value at the instant $t_2$, and then begins to decay, as shown in FIG. 3.

At the instant $t_3$, the unit ECU causes closure of $SW_1$ and the switch B in the by-pass branch. Consequently, the storage inductor $L_1$ is by-passed and the energised load $L_i$ is connected directly to the battery $V_B$. As a result of this connection, the battery causes a current to flow in the load, the current tending towards the value of the ratio between the battery voltage and the resistance (usually very small) of the load $L_i$. The current $I_{Li}$ can therefore rise again from the instant $t_3$, as shown in FIG. 3. The by-pass branch circuit can thus enable delayed persistence of very high current levels in the load. Without the intervention of the by-pass branch circuit, the current in the load would tend to decay as indicated by the broken line in the graph of $I_{Li}$ in FIG. 3.

The circuit variant shown in FIG. 4 operates in exactly the same way as the circuit of FIG. 1.

In the circuit of FIG. 4, the direct connection of the load to the supply through the by-pass branch occurs by means of the closure of the switch $SW_1$ immediately after the current in the load has reached its peak value. In this case, as soon as the voltage across the capacitor C falls to a lower value than the battery voltage, the by-pass diode B becomes conductive and brings about the same condition as that which occurs in the circuit of FIG. 1 upon closure of the by-pass branch circuit switch.

The by-pass branch circuit of the above-described circuits also enables the carrying out of another interesting function which will now be described.

If, during operation, a breakdown or malfunction occurs in the storage and discharge circuit $L_1$-C, or if $SW_2$ is damaged, the circuit according to the invention is still able, to some extent, to control the loads, in particular, the electro-injectors.

The control unit ECU can detect the breakdown or malfunction condition by watching the voltage across the capacitor C. In the case of breakdown or malfunction of the above-indicated components, the unit ECU can still control the injectors through the switch $SW_1$ and the by-pass branch circuit. Naturally, the characteristics of the current supplied to the control solenoid of each injector in this situation do not conform absolutely to the ideal curve shown in FIG. 2 but do, however, enable the vehicle to "get home".

I claim:

1. A circuit for controlling an inductive load, particularly for the operation of an electro-injector of a Diesel-cycle internal combustion engine, comprising a low voltage supply, reactive circuit means including an energy-storage inductor, control circuit means including a first controlled switch for connecting the supply to the energy storage inductor to effect a storage of energy, a second controlled switch for causing connection of the reactive circuit means to the inductive load and rapid discharge into the inductive load of the energy stored in the energy storage inductor, so as to inject a current pulse into the load, and current holding means for maintaining the current in the load above a predetermined level immediately after said current pulse has reached its peak value; said current holding means comprising a by-pass branch circuit connected between the first switch and the load and including current conduction control means for enabling the passage of current from the supply to the load when the first and second switches are simultaneously closed.

2. A circuit according to claim 1, wherein the conduction control means in the by-pass branch circuit comprise an additional electronic switch.

3. A circuit according to claim 1, wherein the conduction control means in the by-pass branch circuit comprise a diode.

4. A circuit according to claim 2, including an electronic control unit arranged to operate the controlled switches in a predetermined manner, wherein the unit is arranged particularly to cause closure of the first switch after the current pulse injected into the load has reached its peak value.

5. A circuit according to claim 4, wherein the electronic control unit is arranged to cause closure of the first switch and the additional switch after the current pulse injected into the load has reached its peak value.

6. A circuit according to claim 4 wherein the electronic control unit is arranged to detect conditions of breakdown or malfunction of the reactive circuit means and, in this event, to cause connection of the load to the supply through the by-pass branch circuit so as to cause direct passage of a pulse of current from the supply to the load.

* * * * *